US005411700A

United States Patent [19]

Martin

[11] Patent Number: 5,411,700

[45] Date of Patent: May 2, 1995

[54] FABRICATION OF GAMMA TITANIUM (TIAL) ALLOY ARTICLES BY POWDER METALLURGY

[75] Inventor: Ricky L. Martin, Gardens, Fla.

[73] Assignee: United Technologies Corporation, Hartford, Conn.

[21] Appl. No.: 132,733

[22] Filed: Dec. 14, 1987

[51] Int. Cl.[6] ..... C21D 1/00; C22C 14/00

[52] U.S. Cl. ..... 419/29; 75/245; 148/421; 419/48; 420/418

[58] Field of Search ..... 148/11.5 F, 11.5 P, 148/421; 419/48, 29; 420/418; 75/245

[56] References Cited

U.S. PATENT DOCUMENTS 2,755,184 7/1956 Turner, Jr. et al. ..... 419/46
2,917,383 12/1959 Saller ..... 419/46
3,052,538 9/1962 Jech et al. ..... 75/245
3,950,166 4/1976 Obara et al. ..... 419/46
3,976,482 8/1976 Larson ..... 419/23
4,292,077 9/1981 Blackburn et al. ..... 420/418
4,294,615 10/1981 Blackburn et al. ..... 420/420
4,432,795 2/1984 Andersen ..... 75/245
4,601,876 7/1986 Yamashita et al. ..... 419/23
4,668,470 5/1987 Gilman et al. ..... 419/32

*Primary Examiner*—Richard O. Dean
*Assistant Examiner*—Robert R. Koehler
*Attorney, Agent, or Firm*—Charles E. Sohl

[57] ABSTRACT

Powder metallurgy techniques are disclosed for fabricating gamma titanium alloy articles (TiAl type alloys) from mixture of powder wherein one species is based on $Al_3Ti$ and the other $Ti_3Al$. Mixtures of these powders in the proper ratio can be compacted, worked, and heat treated to form the desired gamma TiAl alloy.

3 Claims, 1 Drawing Sheet

500 X

500 X

500 X

500 X

FABRICATION OF GAMMA TITANIUM (TIAL) ALLOY ARTICLES BY POWDER METALLURGY

TECHNICAL FIELD

This invention relates to the powder metallurgy fabrication of gamma titanium alloy articles.

BACKGROUND ART

Titanium and its alloys have unique combinations of low densities and high melting points which lead to their widespread application in high technology applications, particularly in gas turbine engines.

A large number of titanium alloys have been proposed. These generally comprise at least about 80% titanium with balance being other additions including aluminum, vanadium, chromium, zirconium, etc. The widely used commercial alloys of this type have either an alpha or beta structure, both of which are essentially titanium solid solutions.

Research has also been conducted aimed at utilizing various titanium intermetallic compounds based on titanium. These include $Al_3Ti$, $Ti_3Al$, and TiAl. The TiAl composition is the one of interest with respect to this invention. It has a high melting point, approximately 2600° F., and a low density, even lower of that of titanium because of the large amount of aluminum present. One draw back of TiAl is its lack of useful ductility. Various alloying approaches have been taken to overcome this problem with a certain degree of success. U.S. Pat. No. 4,294,615 which shares a common assignee with the present application, discloses that the addition of a small amount of vanadium increases the ductility of TiAl type compositions and that the addition of a small amount of carbon increases the creep rupture strength of such materials. This patent also describes some of the earlier work in the TiAl system. The patent is incorporated herein by reference.

Being an intermetallic material with high strength, low to moderate ductility, and high melting point, TiAl type alloys have in the past been formable only with the greatest of difficulty. Invariably, forming is conducted at a high temperature, generally in excess of about 2400° F. for reasons of ductility. This requirement poses a problem for the production of certain thin section alloy shapes, particularly sheet material. Sheet material is formed by rolling, but when thin sheet is being formed, the heat extraction capability of the rolls is such that the material between the rolls rapidly loses its heat and then cracks as it becomes too cold. The obvious approach would be to heat the rolls to the hot rolling temperature, but this is impractical given the temperatures involved. To my knowledge crack free TiAl sheet having a thickness of 0.1 inch and below has never been produced.

Similar difficulties can be envisioned in forming TiAl type materials in different thin section shapes by other processes such as by forging.

Other titanium-aluminum compounds do not suffer from this great lack of ductility. In particular, $Al_3Ti$ and $Ti_3Al$ display useful ductilities.

As used herein, the terms $Ti_3Al$, $TiAl_3$ and TiAl include minor alloying elements which do not significantly change the crystal structure of the phases. These terms are also intended to denote materials which contain up to about 10% by volume of other phases in the case of $Ti_3Al$ and $Al_3Ti$ and up to about 20% by volume of other phases in the case of TiAl. That is to say, a structure comprised of 85 volume % TiAl, 5 volume % $Al_3Ti$ and 10 volume % $Ti_3Al$ is considered to be TiAl.

DISCLOSURE OF INVENTION

It is an object of the present invention to provide a practical method for forming complex shapes and especially shapes with thin sections of TiAl type compositions.

The prior art has disclosed the broad ranges for the TiAl type compositions and has discussed at some length various alloying additions which may be made to this type of alloy for different purposes, mainly for improved ductility. To the best of my knowledge, however, the prior art has always contemplated forming and fabricating TiAl compositions from a homogeneous preform, a preform which has its origins as a cast product of essentially a TiAl composition.

My invention is the use of powder metallurgy to form TiAl compositions from a mixture of starting powders, one based on $Al_3Ti$ and the other based on $Ti_3Al$. One skilled in the art can readily visualize that such a mixture of powders can be fabricated which will have an overall net composition lying within the TiAl gamma phase region.

According to my invention such a mixture of powders is formed and is compacted to form a preform, a homogeneous mass of essentially full density.

The resultant preform will have useful ductilities especially if its exposure time at elevated temperature is kept at a minimum. The preform can be heated to an elevated temperature and formed into a useful shape, for example by rolling despite losing heat to the rolls. The formed article, having essentially a final shape is then heated at an elevated temperature for a time sufficient to allow diffusion between the $Al_3Ti$ and. $Ti_3Al$ constituents and thereby the formation of the desired TiAl compositions. The resultant article contain a predominate amount of TiAl and can have useful ductilities by virtue of alloying additions added to the precursor powders.

The foregoing and other features and advantages of the present invention will become more apparent from the following description and accompanying drawings.

BEST MODE FOR CARRYING OUT THE INVENTION

Figure 1:
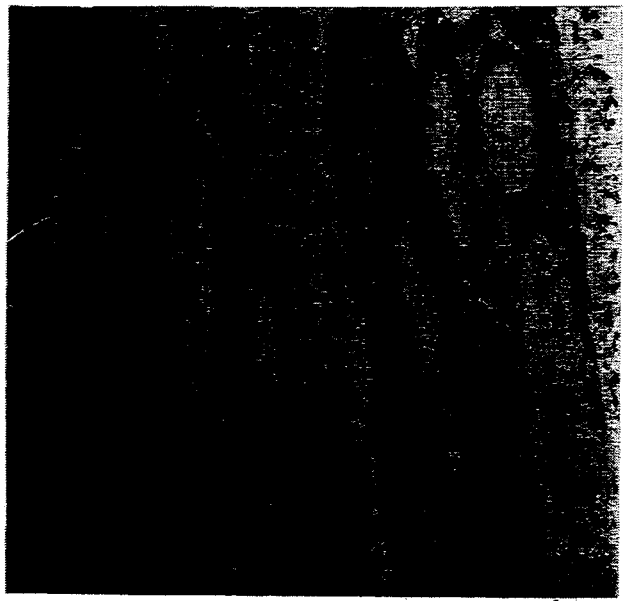
FIG. 1 shows a photomicrograph of as forged material.

According to the present invention shapes of the difficult to form TiAl material are formed from a preform consisting of $Al_3Ti$ and $Ti_3Al$ powders in a ratio such that TiAl can be formed by subsequent diffusional heat treatment.

I have used powder produced by rotary atomization which also provides an extremely rapid cooling rate from the liquid. However, the cooling rate is not essential to the success of the invention and nor for that matter is the highly spherical powder geometry. It is my belief that powders formed by other techniques have equal utility in my invention.

I believe that a useful range of powder particle sizes for application to the present process is from about −40 to −120 U.S. standard sieve size. Powders falling within this size range should be formed from an $Al_3Ti$ type composition and a $Ti_3Al$ composition. Alloying additions which may be desired to enhance ductility or other alloy properties may be made to either or both of the alloy species.

The ratio of the powders to arrive at the desired TiAl composition will depend in part upon the alloying additions which may have been made. The gamma type alloys, although based on an intermetallic compound, have a fairly wide composition range of from about 35 wt. % to about 45 wt. % aluminum (in the absence of other alloying elements). The skilled practitioner will have no difficulty in determining the ratio of $Ti_3Al$ and $TiAl_3$ materials necessary to arrive at the desired composition within the gamma range. The appropriate mixture of powders can be placed in a sheet metal container, a can, which may for example be made of stainless steel, and may be consolidated at a temperature in the range of 1600° F.–2000° F. i.e. 1800° F. at a pressure ranging from 20–40 ksi i.e. 30 ksi for a time period from about one-half to about ten hours. This will produce a powder compact having a density at least 95% of theoretical density.

The can then be removed by either mechanical or chemical means. The compact can then be forged or extruded to an intermediate shape. Forging or extrusion can be conducted at a temperature of from about 1700° F. to about 2100° F. A typical strain rate would 0.1 inch per inch per minute.

It should again be pointed out that while both the starting powders are of materials which have reasonable ductility, they will react by diffusion after compaction to form a much stronger much less ductile TiAl structure. Accordingly processing should be conducted in a timely fashion and at as low a temperature as possible consistent with achieving the desired results. This will minimize the formation of TiAl during processing and thereby inhibit its possible interference with deformation processing.

A major product at which this invention is aimed is thin sheet material which might be used for example in the fabrication of honeycomb. The intermediate product produced by forging or extrusion is again canned but this time in a stronger alloy such as columbium. The choice of canning alloy in this instance is dictated by the desire to have a can which has a similar resistance to deformation at the selected temperature as the preform. Yttria can be used between the preform and the can to minimize diffusion and/or bonding between the can and preform. The canned material can then be hot rolled in an elevated temperature between 2000° F. and 2400° F. to the desired thickness and the can can then be removed.

The hot rolled material is then heat treated to encourage total diffusional interaction between $Ti_3Al$ and $Al_3Ti$ constituents to form the TiAl gamma structure. The time and temperature of this diffusional heat treatment will depend to some extent on the initial powder sizes employed. Larger powder sizes will provide a material having longer diffusional distances and less interface area and will need more time and/or higher temperature. Times from about 2–20 hours at 2200° F.–2500° F. will be typical with the useful range of powder sizes.

The invention may be better understood by reference to the following specific illustrative example.

EXAMPLE 100 grams of −100 mesh Al-25 atomic % titanium was mixed with 194 grams of −50 mesh Ti-24 atomic % aluminum −11 atomic % niobium. Mixing was conducted in a V blender for about 2 hours. The blended powder was then placed in a stainless steel canister and vacuumed hot pressed in a vacuum in the range of 0.0001 torr. The powder is first soaked at 1700° F. temperature for one hour and then consolidated at a pressure of 30 ksi for two hours at 1700° F. The resultant compact measured about 1.5 inches in diameter and 4 inches in length.

The can was removed by mechanical means. The compact was then forged in a 500 ton vacuum press. The compact was soaked at 1850° F. for one hour before forging at 1850° F. at a strain rate of 0.1 inch per inch per minute using molybdenum dies. The resultant pancake was about 0.25 inch thick and had a microstructure shown in FIG. 1.

A rolling preform was made by cutting a rectangular shape from this pancake and placing it on a flat picture frame can made from columbium alloy C103. Prior to placing the pancake into the can cavity all internal surfaces were coated with yttria to inhibit reaction between the titanium materials and the columbium can. The can assembly was TIG welded along the seams and was beveled at the leading edge to assist in the initial rolling step.

Figure 2:
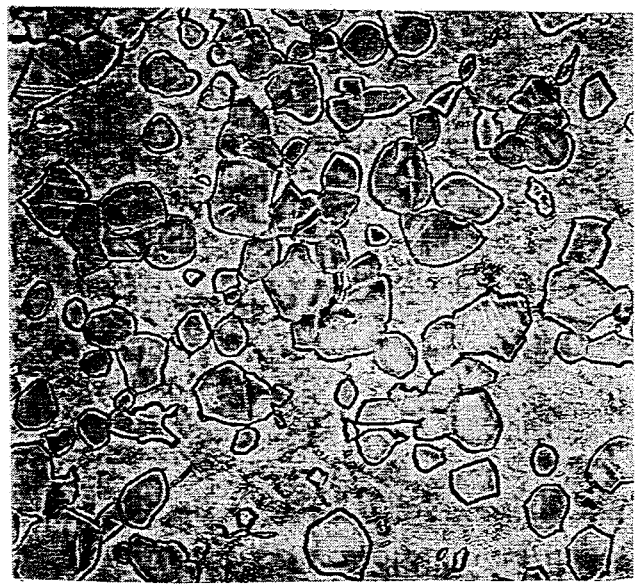
FIG. 2 shows a photomicrograph of as rolled material.

Rolling was performed on a conventional rolling mill at a temperature of 2200° F., a relatively low temperature which was selected to inhibit further transformation of the starting material to be stronger TiAl material. The material was first soaked for twenty minutes and then rolled using a pass schedule shown in Table 1 with intermediate reheats as shown. It will be appreciate that this is an aggressive rolling schedule which was selected based on a desire to inhibit the TiAl formation to the extent possible. Following this step x-ray diffraction analysis of the rolled material showed that it had not yet totally transferred to the gamma structure. Rolling was completely successful despite the large pass reduction taken. Final thickness achieve was about 0.07 inch. It is to my knowledge the thinnest sheet ever successfully produced having an overall TiAl composition. FIG. 2 shows the as rolled microstructure.

Figure 3:
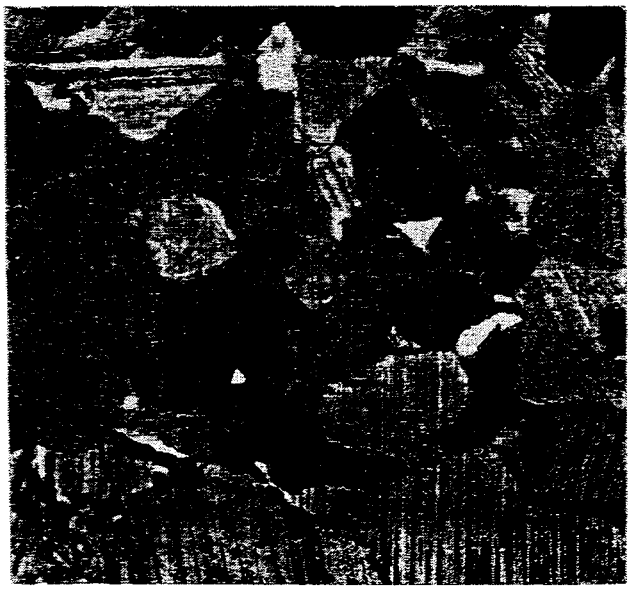
FIG. 3 shows a photomicrograph of homogenized material.

This rolled sheet was then given a diffusion treatment in vacuum at 2400° F. for ten hours in an effort to completely transform the starting materials to the TiAl material. Commercially pure titanium sheet was used to surround the rolled stock to protect it from absorbing oxygen. After homogenization x-ray diffraction analysis was done to confirm that the majority material had transformed to gamma. The microstructure of the homogenized sheet is shown in FIG. 3. The lamellar structure is typical of that seen in gamma microstructures. The alpha two phase, $Ti_3Al$, was also found by x-ray analysis. This is not surprising since the overall nominal composition selected is slightly rich in titanium which permits some alpha two phase to exist at equilibrium. Such as a titanium rich gamma alloy is generally considered to be even more difficult to fabricate than a completely pure TiAl structure would be.

Although this invention has been shown and described with respect to detailed embodiments thereof, it will be understood by those skilled in the art that various changes in form and detail thereof may be made without departing from the spirit and scope of the claimed invention.

I claim:

1. A method for producing gamma (TiAl) titanium alloy articles including the steps of:

a) compacting a mixture of $Al_3Ti$ and $Ti_3Al$ powders, whose overall composition lies within the TiAl phase field, into a preform;

b) hot working the preform into a final shape; and c) homogenizing the hot worked article under conditions which promote interdiffusion and TiAl formation.

2. A compacted precursor whose overall composition is that of TiAl consisting essentially of a compact formed of $Ti_3Al$ and $TiAl_3$ powders.

3. A crack free sheet material whose thickness is less than about 0.1 inch and whose overall composition is TiAl.

* * * * *